US008893889B2

(12) United States Patent
Soukup et al.

(10) Patent No.: US 8,893,889 B2
(45) Date of Patent: Nov. 25, 2014

(54) INTERLOCKING CRATE AND SHIPPING CONTAINER SYSTEM

(71) Applicant: Tru Vue, Inc., Faribault, MN (US)

(72) Inventors: Nate Soukup, Owatonna, MN (US); Joel T. Anderson, Cottage Grove, MN (US); Jason Stevenson, Lakeville, MN (US)

(73) Assignee: TruVue, Inc., Faribault, MN (US)

( * ) Notice: Subject to any disclaimer, the term of this patent is extended or adjusted under 35 U.S.C. 154(b) by 45 days.

(21) Appl. No.: 13/673,067

(22) Filed: Nov. 9, 2012

(65) Prior Publication Data

US 2014/0131241 A1 May 15, 2014

(51) Int. Cl.

| | |
|---|---|
| ***B65D 85/48*** | (2006.01) |
| ***B65D 6/28*** | (2006.01) |
| ***B65D 6/02*** | (2006.01) |
| ***B65B 23/20*** | (2006.01) |
| ***B65D 57/00*** | (2006.01) |
| ***B65D 19/16*** | (2006.01) |
| ***B65D 6/00*** | (2006.01) |
| *B65D 85/62* | (2006.01) |

(52) U.S. Cl.

CPC . *B65B 23/20* (2013.01); *B65D 9/06* (2013.01); *B65D 2519/00034* (2013.01); *B65D 2519/00273* (2013.01); *B65D 2519/00587* (2013.01); *B65D 2519/00641* (2013.01); *B65D 2519/00333* (2013.01); *B65D 2519/00288* (2013.01); *B65D 2519/00174* (2013.01); *B65D 2519/00169* (2013.01); *B65D 85/62* (2013.01); *B65D 2519/00711* (2013.01); *B65D 85/48* (2013.01); *B65D 2519/00572* (2013.01); *B65D 2519/00164* (2013.01); *B65D 2519/00323* (2013.01); *B65D 57/00* (2013.01); *B65D 2519/00029* (2013.01); *B65D 2519/00497* (2013.01); *B65D 2519/00199* (2013.01); *B65D 2519/00208* (2013.01); *B65D 2519/00203* (2013.01); *B65D 2519/00024* (2013.01); *B65D 19/16* (2013.01); *B65D 9/32* (2013.01)

USPC ..... 206/454; 206/555; 220/4.26

(58) Field of Classification Search

USPC ..... 206/449, 454, 555, 556; 220/4.26, 4.28

See application file for complete search history.

(56) References Cited

U.S. PATENT DOCUMENTS

| | | | | |
|---|---|---|---|---|
| 1,146,149 | A | 7/1915 | Freeze | |
| 3,603,455 | A | 9/1971 | Bareiss | |
| 4,583,639 | A * | 4/1986 | Fedick et al. | 206/454 |
| 4,688,979 | A | 8/1987 | Kupersmit | |
| 4,789,065 | A * | 12/1988 | Roy | 206/555 |
| 5,259,523 | A * | 11/1993 | Scherb | 220/4.26 |
| 5,423,114 | A | 6/1995 | Johnson | |
| 2003/0173396 | A1 | 9/2003 | Naughton et al. | |
| 2007/0261219 | A1 | 11/2007 | Koch et al. | |
| 2011/0309072 | A1 | 12/2011 | Rio Gonzalez et al. | |

* cited by examiner

*Primary Examiner* — Byron Gehman

(74) *Attorney, Agent, or Firm* — Dorsey & Whitney LLP

(57) ABSTRACT

A shipping container system comprises a bottom panel, a plurality of side panels, and a top panel, each with interlocking features. The side panels interlock with the bottom panel to assemble a self-supporting shipping container. A plurality of horizontally oriented slots are formed in an opposing pair of the side panels, and arranged at different heights between the bottom panel and a top edge of the side panels. A cross member is positioned at a selected height by insertion into an opposing pair of the slots, in order to restrain one or more shipping units against vertical motion inside the shipping container. The top panel interlocks with the side panels to cover the shipping container, and is spaced above the plurality of shipping units at a clearance maintained by the cross member.

16 Claims, 6 Drawing Sheets

INTERLOCKING CRATE AND SHIPPING CONTAINER SYSTEM

BACKGROUND

Glass panels are utilized in a wide range of industries, including window, door, and insulated glass unit manufacturing for commercial and residential construction. Additional applications include architectural glass, building renovations, and specialty interior applications, including custom framing and displays. Across these applications, glass pane shipping, handling, and transportation considerations raise a number of design challenges, particularly when shipping unframed (sheet) glass units in different sizes and quantities.

In general, sheet glass units are initially manufactured in standard sizes, and delivered in fixed quantities. This allows for the use of modular shipping containers, with predefined external dimensions and uniform internal packing geometry, in order to reduce breakage and also production and handling costs.

Glass units are often stacked vertically during shipping and transfer operations, in fixed-quantity sets corresponding to the predefined capacity of the standardized shipping container. This produces a fully-packed interior container geometry. The vertically aligned glass sheets are supported against the side or end walls during transportation, limiting relative movement and reducing losses. Spacers may also be utilized, and the stacks of glass may be wrapped to reduce relative displacement, for example with a shrink-wrap or heat sensitive plastic sheet material.

In some industries, however, individual unit sizes vary. In addition, as the supply chain moves from large-scale glass sheet production toward individual wholesale and retail delivery, shipping quantities must be filled on the basis of customer demand, rather than container size. This is particularly true in custom window and door manufacturing, and in framing and display applications, where there is no guarantee or even expectation that individual customer orders will correspond to the pre-defined numbers and sizes used in larger-scale glass sheet containers.

When different quantities of glass are to be shipped, therefore, additional packaging and handling time is required, in order to ensure safe delivery of customer orders that do not conform to standard shipping container dimensions. Where cost and efficiency are market factors, this raises a number of design considerations, particularly as directed to shipping glass sheets and other fragile items in non-standard unit sizes and quantities.

SUMMARY

This disclosure is directed to an interlocking, self-supporting shipping container system, and corresponding methods of use. Depending on configuration, the system may include bottom, side, and top panels with interlocking features disposed about their perimeters. The side panels interlock with the bottom panel, in order to assemble a self-supporting shipping container.

A number of horizontally oriented slots are formed in opposing side panels, arranged at different heights. One or more cross members may be positioned at selected heights by insertion into the opposing slots, in order to restrain the shipping units inside the container against vertical motion. The top or cover panel interlocks with the side panels to cover the shipping container, and is spaced above the shipping units at a clearance maintained by the cross member.

This arrangement isolates the shipping units from external loading, by transferring forces on the cover to the side panels. Cross braces can also be provided, spanning opposing side panels at the top edge, in order to provide additional cover support. The cross braces can be spaced above the plurality of shipping units, providing further load isolation and improved load transfer to the side panels.

In additional examples, the interlocking features are selected from complementary tongue-in-groove features, tabs, and castellations. The interlocking features can be configured for hand assembly of the bottom, side and top panels into the self-supporting shipping container, without separate mechanical fasteners or complex tools, and for easy disassembly.

Vertically oriented channels can be formed in opposing side panels, extending along and adjoining the horizontally oriented slots. The channels may have a horizontal width configured for positioning the cross members at selected heights by insertion along the channels and into the opposing pair of slots. In addition, the slots can be configured to retain the adjustable cross members in a compressive loading relationship with respect to the shipping units, for example stacked glass plates extending across the horizontal surface area of the bottom panel.

In other configurations, a shipping apparatus includes interlocking bottom and side panels assembled into a self-supporting container, without mechanical fasteners. Shipping units can be disposed within the container, stacked substantially parallel to the bottom panel.

Horizontally oriented slots are formed at different heights in the side panels, with a cross member inserted into a pair of the slots at a height selected to restrain the shipping units against vertical motion. A top panel interlocks with the plurality of side panels to cover the shipping container, spaced above the shipping units at a clearance maintained by the cross member. A cross brace is positioned between a pair of the side panels, located at the top edge of the container to support the top panel against external loading.

The shipping units can include stacked glass plates extending across the horizontal surface area of container. The slot height can be selected to position the cross member in a compressive loading arrangement with respect to the shipping units, and a spacer can be positioned to convey the compressive loading from the cross member to the stacked glass plates.

The interlocking features may include one or more pry openings for disassembly of the shipping container without removal of any mechanical fasteners. Shipping bands can be disposed about the shipping container, in order to load to hold the panels in position during transport.

In shipping applications, interlocking side and bottom panels are assembled to form a self-supporting shipping container. The container is loaded with a plurality of shipping units, extending across the bottom panel in a parallel orientation.

A cross piece is inserted into a pair of opposing horizontal slots formed in the side panels, at a height selected to position the cross piece to restrain the shipping units against vertical motion. The shipping container is closed with an interlocking top panel, spaced above the shipping units.

A cross brace isolates the shipping units from compressive loading on the top panel, by transferring the compressive loading to the side panels. The brace can be inserted along vertical channels extending from top edges of opposing side panels to the pair of opposing slots. The top, side and bottom panels can be disassembled without removal of any mechanical fasteners.

Although described in terms of particular examples, this disclosure also encompasses additional options and features. In particular, these various aspects of the shipping system, apparatus and method examples can also be interchanged and combined to generate additional forms, without loss of generality, and remaining within the scope of the disclosure.

DETAILED DESCRIPTION

Figure 1:
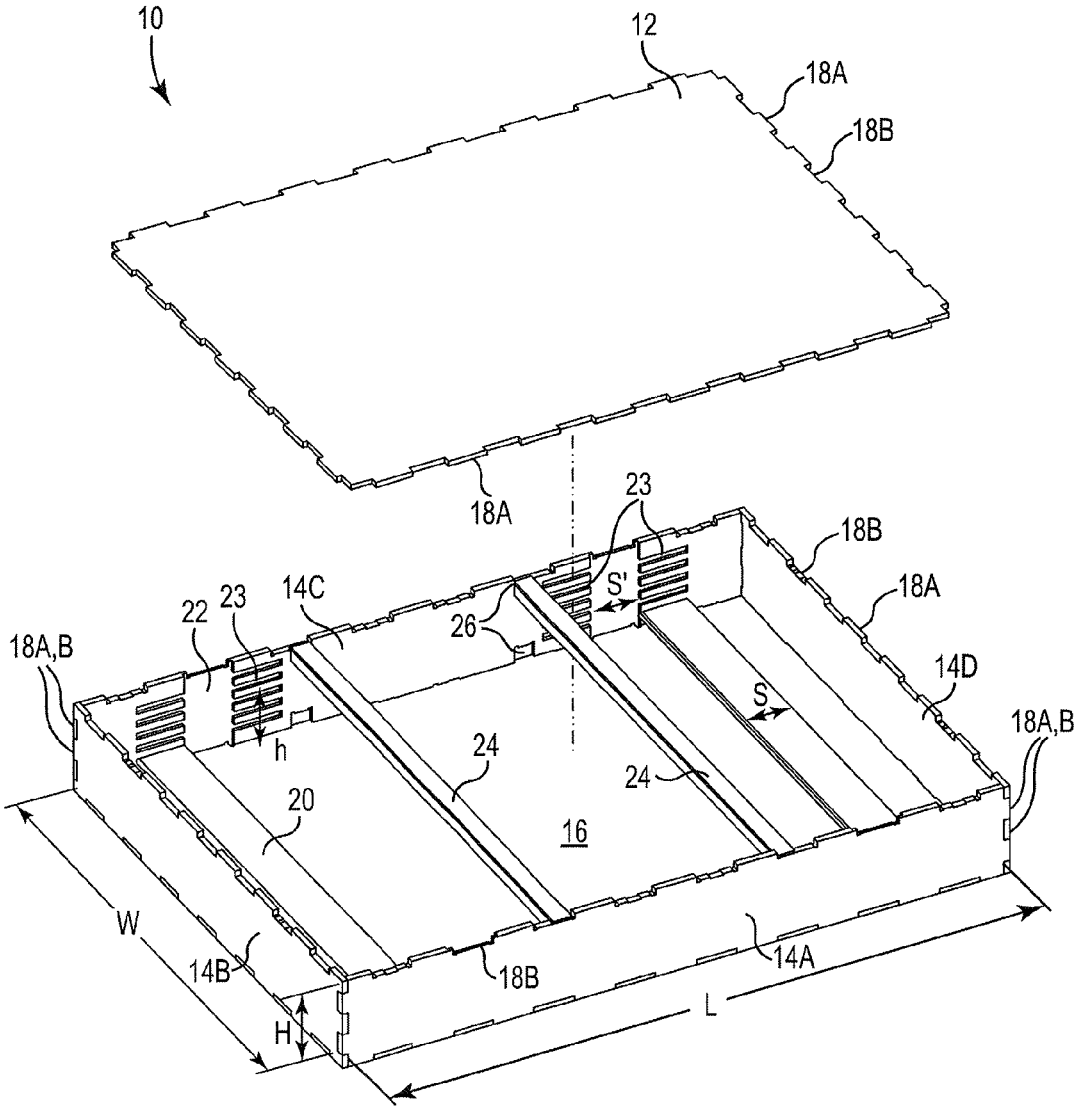
FIG. 1 is a perspective view of a self-supporting, interlocking shipping container system.

FIG. 1 is a perspective view of an interlocking, self-supporting shipping crate or container system 10. As shown in FIG. 1, shipping container system 10 includes interlocking top or cover panel 12 (shown removed), interlocking side panels 14A, 14B, 14C, and 14D, and interlocking bottom panel 16.

Interlocking panels 12, 14A-14D and 16 can be assembled and disassembled by hand, or using simple tools, in order to form shipping container 10 as a self-supporting structure. Shipping container system 10 also allows for easy assembly, disassembly and flat storage, without inserting or removing any mechanical fasteners. In addition, container system 10 provides for improved loading and unloading techniques to accommodate a range of partial and full shipping configurations, as described below, for glass sheets and other fragile or load-sensitive shipping units.

Depending on size, cost, and structural requirements, cover panel 12, side panels 14A-14D, and bottom panel 16 may be formed of a variety of materials, including wood, plywood, oriented strand board (OSB), and wood fiber composites. Alternatively, panels 12, 14A-14D and 16 can be formed of plastic or metal materials, or from a composite material such as a fiber-resin matrix.

In assembled form, shipping container 10 has interior length L, interior width W and interior height H. In use, length L and width W are typically horizontal dimensions, with width W less than or equal to length L ($W \leq L$), and vertical height H less than or equal to horizontal width W ($H \leq W$). Alternatively, dimensions L, W and H may vary, providing container system 10 with a range of different square and rectangular aspect ratio configurations. Horizontal and vertical dimensions L, W, and H can also be interchanged without loss of generality, for example by rotating container system 10.

As shown in FIG. 1, top panel 12, side and end panels 14A-14D, and bottom panel 16 are provided with complementary, interlocking features 18A and 18B, for example interlocking tabs, tongue-in-groove features, or castellations. Interlocking features 18A and 18B are configured with relatively close tolerance and fit, allowing container system 10 to be assembled and disassembled by hand, without the need for complex tools or other mechanical fasteners.

Interlocking top panel 12, side panels 14A-14D and bottom panel 16 are also configured for hand assembly of shipping container 10 as a self-supporting structure, with or without cover panel 12. With interlocking features 18A and 18B, top, side and bottom panels 12, 14A-14D and 16 provide for repeated cycles of assembly, loading, unloading, disassembly and flat storage of container system 10, without the need for inserting and removing screws, nuts, bolts, clips, or other mechanical fasteners. This allows for repeated shipping operations in relatively simple environments, including warehouses, frame shops and loading docks, without the need for complex tools and infrastructure.

In some applications, simple hand tools such as a hammer, mallet, pry bar or screwdriver may also be utilized, for example to encourage a close fit between interlocking features 18A and 18B, or to guarantee dimensional tolerances in overall length L, width W, and height H. This contrasts with shipping crate designs held together by a combination of screws, nuts, bolts, nails, clips, and other discrete mechanical fastening elements, which must be individually removed and replaced each time the crate is taken apart and re-assembled. Container system 10 also provides a self-supporting structure during loading and unloading, based on the design of interlocking features 18A and 18B on top, side, and bottom panels 12, 14A-14D, and 16, without the need for separate mechanical fasteners.

Shipping container system 10 cam also be provided with one or more adjustable cross members 20, which span opposing side or end panels 14A-14D to accommodate different loading configurations with reduced shifting and breakage potential. Cross members or dividers 20 are inserted into open shipping container 10 along vertical channels 22, sliding into selected pairs of opposing horizontal slots 23. Slots or openings 23 are formed at different heights h along one or both sides of channels 22, in order to position cross members 20 to restrain the internal load against vertical motion, with respect to bottom panel 16.

Depending on configuration, vertical channels (or vias) 22 may extend down from the top edge of opposing side panels 14A and 14C, as shown in FIG. 1, with adjustable cross members 20 spanning shipping container 10 along width W. Alternatively, channels 22 and slots 23 can be formed in opposing end panels 14B and 14D, with adjustable cross members 20 spanning shipping container 10 along length L.

Height adjustment is performed after loading, with shipping container 10 in assembled form. This is accomplished, for example, by forming channels 22 with substantially the same or greater span width (S') than that of cross members 20 (with width S); that is, channel width S' can be greater than or equal to cross member width S ($S' \geq S$). This configuration allows for relatively close tolerance during insertion of cross members 20 in horizontal slots 23. Alternatively, span width S' of one or more channels 22 can be about equal to or even somewhat less than that of cross members 20 (that is, $S' \leq S$). In this configuration, greater tolerance may be provided in the openings to slots 23, to allow for insertion of cross members 20 by rotation from a relatively vertical orientation in channel 22, to a relatively horizontal orientation in opposing slots 23.

Cross braces 24 may also be provided, spanning width W or length L of shipping container 10 between opposing side panels 14A and 14C, or 14B and 14D. In contrast to adjustable height cross members 20, however, cross braces 24 are located in notches 26 formed along the top edges of two or more side panels 14A-14D, in order to support cover panel 12 when assembled onto the top of shipping container 10. Cross braces (or cover braces) 24 also provide load transfer and load isolation functions, as described in more detail below.

Cross brace notches 26 can also be provided at the bottom edges of side or end panels 14A-14D, as shown in FIG. 1, making container system 10 more symmetric. Adjustable cross member channels 22 and slots 23 can also be symmetrically formed, allowing container 10 to be inverted or flipped to interchange top and bottom panels 12 and 16, along with opposing pairs of side or end panels 14A-14D, without loss of generality.

Figure 2:
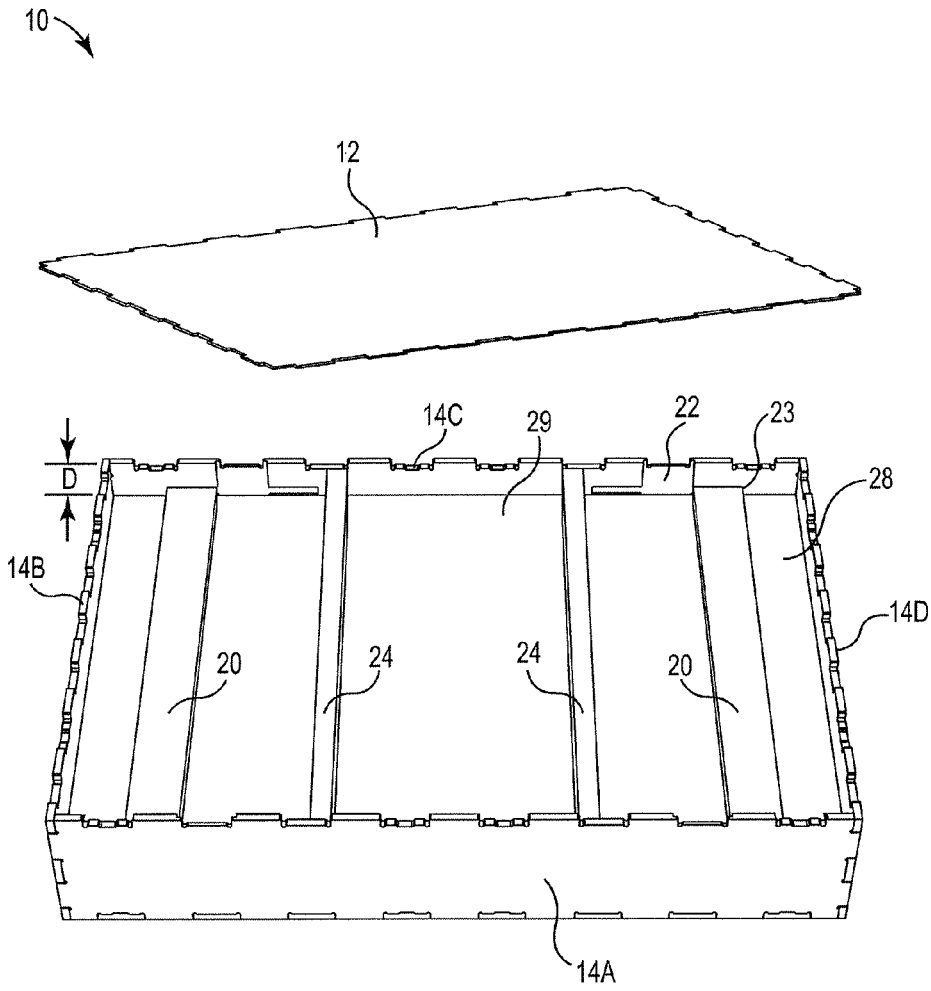
FIG. 2 is an alternate perspective view the shipping container system, in a loaded configuration.

FIG. 2 is a perspective view of shipping container system 10, in a loaded configuration with top panel 12 removed. As shown in FIG. 2, a partial or full load of glass sheet stacks or other shipping units 28 are provided within container system 10, with clearance D between the top of the load and the bottom of cover panel 12 (when assembled). Clearance D is the difference between the actual load height and the internal height of shipping container 10, as determined by the number of shipping units 28 and any additional spacers 29.

In glass shipping applications, individual cartons or shipping units 28 typically include one or more glass sheets, extending across the horizontal surface area inside shipping container 10, substantially parallel to bottom panel 16. For example, glass shipping units 28 may each include from one to twelve or more individual glass sheets in an adjacent stacked configuration, with an external cover of paper or cardboard. Alternatively, shipping units 28 may include a range of different materials, including, but not limited to, window units, architectural glass, and flat panel displays. More broadly, shipping units 28 also encompass other substantially flat or planar items provided in modular form, for which partial loading, breakage, and related shipping considerations are market factors.

In other embodiments, the slots 23 may be positioned in any desired configuration, for example, vertically, horizontally, or diagonally. It is to be appreciated that terms used herein such as vertical, horizontal, diagonal, parallel, etc., are not meant to be mathematically precise, and each is modified by the term "generally" or "approximately." The given situation and context will determine the precise orientation, as taught by considerations herein.

As shown in FIG. 2, adjacent shipping units 28 are sometimes separated by spacers 29 (shown in cutaway), for example cardboard, felt, or suitable polymer materials selected for load transfer and shock absorbing properties. Internal or external corner protectors and other vibration and impact features can also be included, either as separate elements, or incorporated into the cover configuration of individual shipping units 28.

As used herein, the terms load and shipment thus encompass any number of shipping units 28 disposed within container system 10, with or without spacers 29 and other packing materials. Similarly, the term shipping unit incorporates stacks of glass plates and any other products or materials included in shipping units (or load elements) 28, with or without spacers 29 and other protective elements.

To reduce motion of such shipping units 28 within container system 10 during transport and handling, one, two or more adjustable cross members 20 can be inserted along channels 22 into slots 23. The bottom surfaces of cross members 20 are positioned adjacent the top surfaces of the load; that is, adjacent the top shipping unit 28 or spacer 29 in container system 10.

Depending on shipping application, cross members 20 can be positioned to bias the load of shipping units 28 against the bottom of container system 10, with compressive loading selected to reduce motion during shipping. Alternatively, a small spacing tolerance may be provided, in order to restrict vertical motion of shipping units 28 within container system 10, with substantially no compressive loading from cross members 20. Additional shims or other spacing members 29 can also be placed on top of shipping units 28, in order to provide the desired spacing tolerance or selected compressive bias.

As shown in FIG. 2, cross braces 24 are positioned across opposing pairs of notches 26, located along the top edge of two or more side or end panels 14A-14D, in order to support top panel 12 when assembled onto shipping container 10. In particular, braces 24 may be placed in top notches 26 when the crate is filled, in order to transfer external loading from top panel 12 to two or more side or end panels 14A-14D, at least partially isolating shipping units 28 from the external loading on top panel 12.

With adjustable cross members 20 positioned in slots 23, clearance gap D is maintained between top shipping unit 28 and the bottom surface of cover panel 12. Cross braces 24 thus support cover panel 12 above the load height of shipping units 28, as defined inside shipping container 10, further isolating the internal shipment from compressive forces on cover panel 12.

Depending on load height, additional clearance can also be maintained between the bottom surface of braces 24 and top shipping unit 28, for further load isolation. Alternatively, cross braces 24 can be placed in a compressive loading relationship with respect to the top surface of shipping units 28 (and any spacers 29), when cover panel 12 is installed. The configuration of shipping container system 10 thus provides a range of clearance and biasing options, as applicable to different partial and full loading configurations, based on the number and loading height of shipping units 28.

These various load-isolating features can also be selected based on handling and transport considerations, in order to reduce the incidence of shipping-related damage to units 28. This allows shipping container system 10 to be configured for protecting either partial or full shipments of glass cartons and other shipping units 28, including protection from non-uniform external loading conditions experienced during handling and transport. These conditions include dropping, rough handling, and jostling, where cover panel 12 may experience transitory load equivalents exceeding one metric ton at accelerations of up to two or three g (that is, up to 20,000-30,000 N), or more.

This contrasts with other shipping configurations, where cartons and boxes of glass units are shipped in full pallet and trailer load quantities, for example using shrink wrap to hold a number of individual shipping units together on a pallet. Open pallet loading does not provide for isolation from top surface loading, and cannot easily accommodate additional items such as accessories to be included in the shipment, whether under full trailer load conditions, or in less than truck load (LTL) transportation and storage.

Container system 10, however, can accommodate even relatively low quantity requests and orders (e.g., three or fewer cartons or other shipping units 28), reducing or eliminating the need for heavy duty custom crating, which is expensive and cannot easily be reproduced in simple shop and warehouse environments, where infrastructure, tools, time and personnel resources are limited. In addition, where top cover panel clearance D is maintained even under substantially full loading configurations, shipping container 10 can also accommodate additional (e.g., small, light) accessories and other items, saving space and reducing logistical considerations for truck, trailer, rail, container shipping, and in warehouse applications. In glass shipping applications, this flexible loading design allows between one and fifteen or more individual glass cartons, windows, insulated glass units, or other glass-based shipping elements 28 to be accommodated inside container system 10, with minimal vertical motion and lateral (horizontal) shifting during shipping and handling, reducing the chance of product damage during delivery.

Shipping container system 10 can also be manufactured from standard wood products and other environmentally green, renewable resources, utilizing existing high speed routers and other standard shop equipment on relatively simple and inexpensive stock materials. This provides ease of manufacture and assembly, combined with flexibility for shipping different quantities of product, including less than truck load (LTL) applications. Container system 10 can also be assembled and disassembled by hand, or using simple tools, with no separate mechanical fasteners, and panels 12, 14A-14D and 16 can be stored flat, reducing container volume and storage requirements when not in use.

In other embodiments, panels 12, 14A-14D and 16 can be assembled using suitable hardware, either in addition to or instead of the use of tongue-in-groove features, tabs, and castellations.

Figure 3:
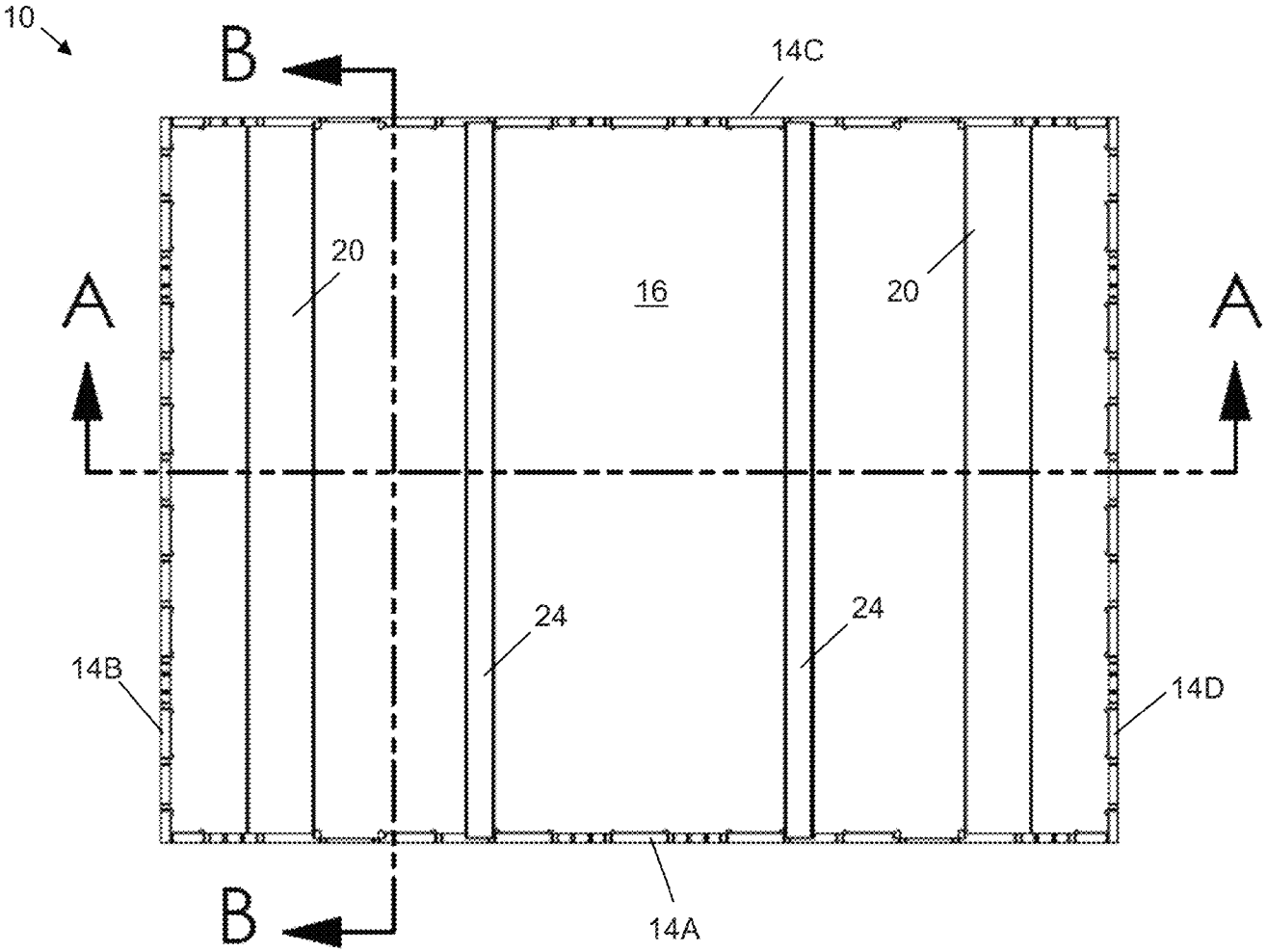
FIG. 3 is a plan view of the shipping container system, in an empty configuration.

FIG. 3 is a top or plan view of shipping container system 10, in an empty configuration, with top cover removed. As shown in FIG. 3, interlocking bottom panel 16 and side panels 14A-14D form shipping container 10 as a self-supporting structure for loading and unloading operations.

After loading container system 10 with glass panel cartons or other shipping units, adjustable cross members 20 are positioned to retain the internal load against vertical motion, for example by providing a compressive bias against bottom panel 16, or by maintaining a close spacing tolerance with respect to the top of the load. Cross braces 24 can be positioned to support the top cover during shipping, transferring external loads to side panels 14A-14D and providing clearance to isolate the shipment from external forces, as described above.

Figure 4A:
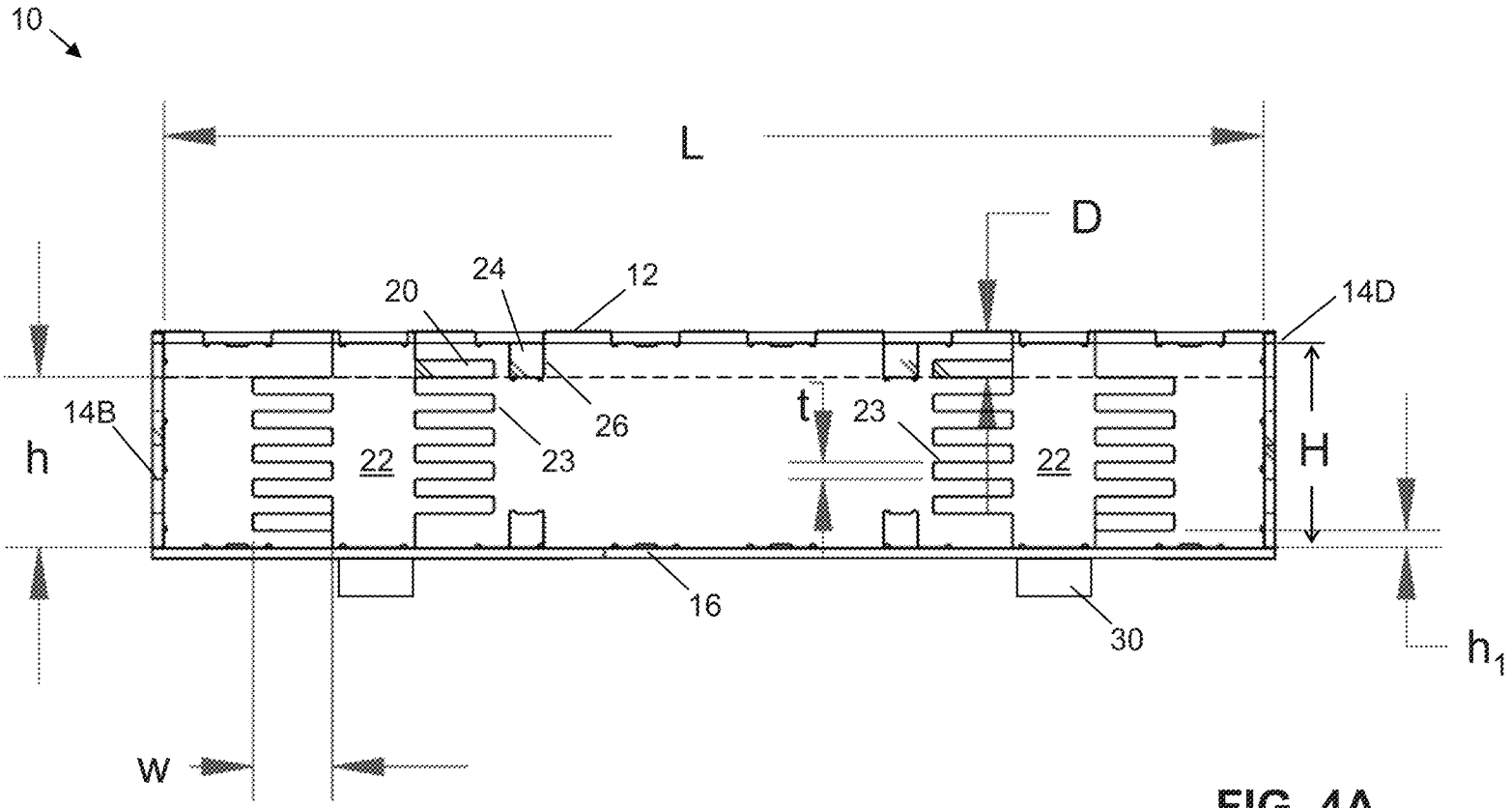
FIG. 4A is a cross-sectional view of the shipping container system, taken along line A-A of FIG. 3.

FIG. 4A is a cross-sectional view of shipping container system 10, taken along line A-A of FIG. 3. Shipping container 10 has internal width L, as measured between the inside surfaces of end panels 14B and 14D, and internal height H, as measured between the inside surfaces of top and bottom panels 12 and 16.

As shown in FIG. 4A, internal load height h is generally less than full internal height H, providing cover panel clearance D. Slots 23 have thickness or height (vertical dimension) t, sized to accommodate adjustable cross members 20, providing vertical load restraint as described above. Cross braces 24 can be positioned in notches 26 adjacent cover panel 12, isolating the internal shipping units from external loading by transferring forces on cover panel 12 to selected side or end panels 14A-14D.

Bottom skids or support blocks 30 may be provided on the outer surface of bottom panel 16. Blocks 30 transfer bottom-surface loads to selected side panels 14A-14D, and provide clearance for drainage and pallet jack or forklift operations. While fasteners such as screws may be used to attach blocks 30 to bottom panel 16, blocks 30 and bottom panel 16 are assembled and disassembled as a unit. This preserves the ability of panels 12, 14A-14B and 16 to be assembled and disassembled in a self-supporting configuration by hand, without the need for additional mechanical fasteners or complex tools.

In one particular application, the heights of consecutive slots 23 are separated by approximately the thickness of the glass cartons or other shipping units, including any spacers, in order to provide cross members 20 at selected shipping or loading heights h that correspond to an integral number of one, two, three or more individual shipping units inside container system 10. Slots 23 can also be provided at different loading heights h, with a corresponding range of different cover clearances D.

For example, clearance D may be selected to align load height h substantially against the bottom surface of cross braces (or cover braces) 24, as shown in FIG. 4A. Alternatively, clearance D can be increased, in order to maintain a gap between load height h and the bottom of cross braces 24. These configurations provide for a combination of load isolation and restraint against motion of the shipping units inside container system 10, as described above and below.

Figure 4B:
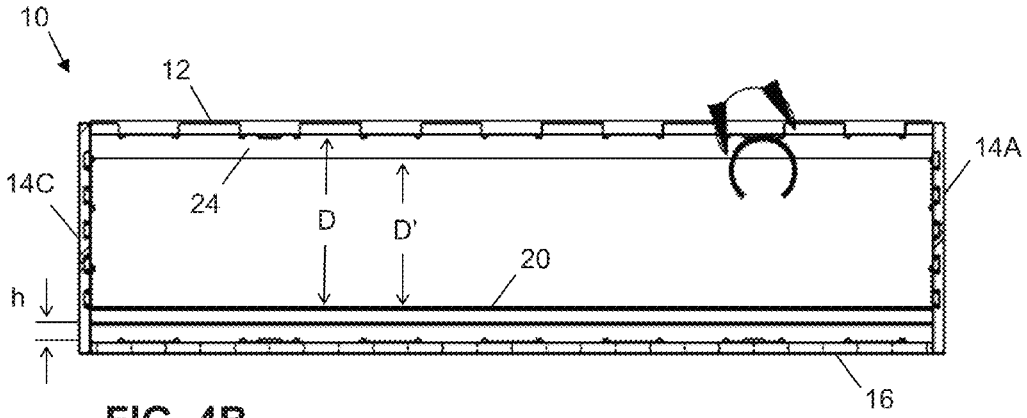
FIG. 4B is an alternative cross-sectional view of the shipping container system, taken along line B-B of FIG. 3.

FIG. 4B is an alternate cross-sectional view of shipping container system 10, taken along line B-B of FIG. 3. Cross brace 24 is positioned to support cover panel 12 on the top of shipping container 10. In this particular configuration, however, adjustable cross member 20 is positioned at a relatively smaller loading height h, as compared to FIG. 4A.

This loading configuration increases clearance D between load height h (at the top of the shipping units) and the bottom of cover panel 12, providing additional clearance D' between shipping height h and the bottom surfaces of cross braces 24. Additional clearance D' increases load isolation by allowing for deflection of cross braces 24, with little or substantially no load transfer from cover panel 12 to the internal shipping units.

Figure 4C:
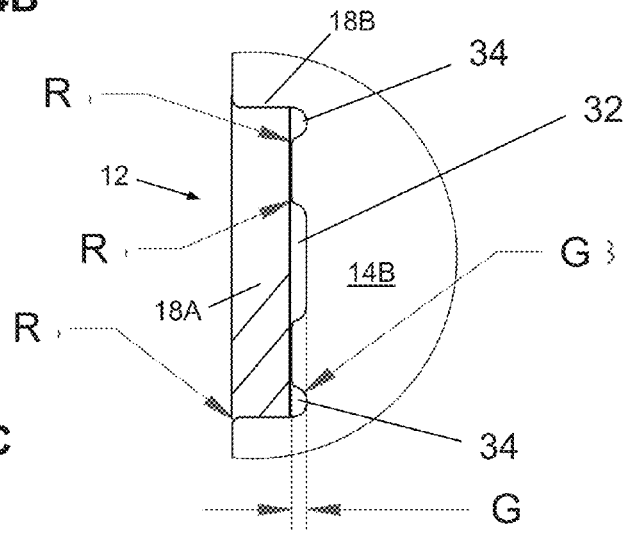
FIG. 4C is a detail view of an interlocking feature for the shipping container system.

FIG. 4C is an expanded view of interlocking tongue-in-groove, tab or castellation features 18A and 18B, taken at detail C as shown in FIG. 4B. Interlocking features 18A and 18B are provided about the periphery or perimeter of top cover panel 12 and side or end panel 14B, respectively, and along other adjacent combinations of interlocking top, side, and bottom panels 12, 14A-14D, and 16. In the particular configuration of FIG. 4C, the interlocking features are formed by a series of alternating tongue or tab elements 18A and complementary interlocking slots or grooves 18B, for example by cutting, routing, or castellating the peripheral edges of interlocking container panels 12, 14A-14D, and 16.

Interlocking features 18A and 18B are formed in a close fitting relationship, in order to provide shipping container 10 in a self-standing or self-supporting configuration during packing and unpacking, allowing for hand assembly and disassembly without the need for mechanical fasteners. Simple tools may also be utilized, for example a hammer or mallet to ensure a close fitting relationship between tongue or tab 18A and complimentary interlocking groove or slot 18B. A screwdriver or pry tool can also be inserted into pry opening 32 (or pry gap G), in order to separate tab 18A from slot 18B. Additional coupling features can also be provided, for example stress relief features 34 and various curvatures or bevels R, for improved fit and durability over repeated cycles of assembly and disassembly.

In alternative embodiments, the crate or container system 10 of the present invention, and its panels 12, 14A-14D and 16, can be assembled using suitable hardware. The hardware, which may take the form of screws, bolts and nuts, nails, glue, or other fasteners, may be used either in addition to or instead of the use of tongue-in-groove features, tabs, and castellations. In some embodiments, the crate or container system 10 of the present invention may be generally permanently constructed. In other embodiments, it may be disassembled.

Figure 5:
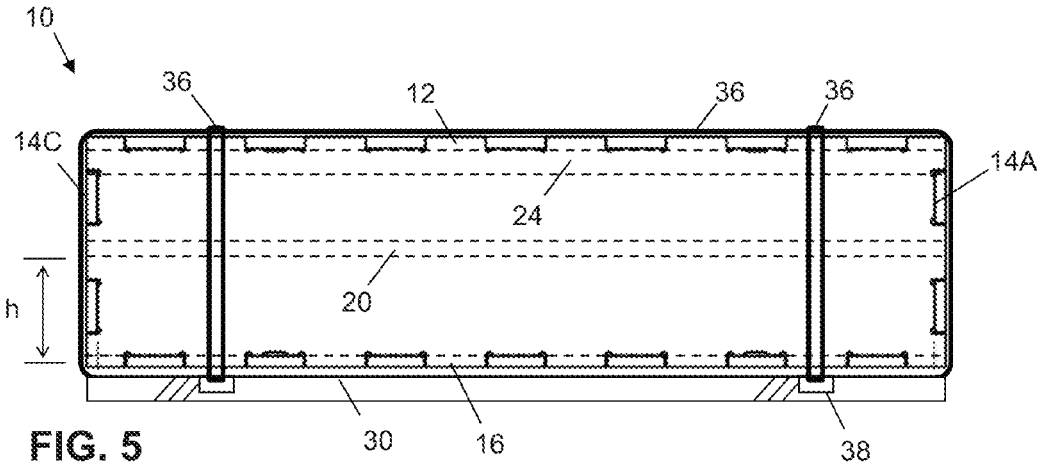
FIG. 5 is a side view of the shipping container system, in a partially loaded configuration.

FIG. 5 is a side view of shipping container system 10, in a partial loading configuration with adjustable cross member 20 (dashed lines) positioned at shipping height h. In this example, shipping straps or bands 36 are also provided, for example after loading container system 10 and replacing cover panel 12. Shipping bands or straps 36 provide compressive loading to hold side panels 14A-14D in place with respect to top and bottom panels 12 and 16, during shipping, handling and transportation.

Shipping bands, cords or straps 36 can be formed of a plastic polymer strap, tape, or metal banding material. Shipping bands 36 are provided around the length or width of container system 10, or around both the length and the width, as shown in FIG. 5. Where container system 10 includes bottom blocks 30, banding or lifting apertures 38 can also be provided, in order to accommodate shipping bands 36 in a close fitting relationship against bottom panel 16.

Shipping bands 36 provide compressive loading, in order to hold panels 12, 14A-14D, and 16 together against vibration, jostling, rough handling, and other (e.g., transitory) loading during shipping and transport operations. On arrival at the shipping destination, bands 36 can be removed by peeling apart by hand, or by using simple tools, such as a knife, shear, or pliers. With shipping bands 36 removed after shipping, container system 10 is provided in a self-supporting configuration for unloading, disassembly and flat storage, as described above.

In other embodiments, no shipping bands 36 are used. In still other embodiments, other fastening mechanisms can be used, either in lieu of or in addition to shipping bands 36. For example, panels can be held in place with suitable hardware or fasteners such as screws, bolts and nuts, nails, or other fasteners, with glue or other more permanent fastening materials being used in locations as appropriate.

Figure 6:
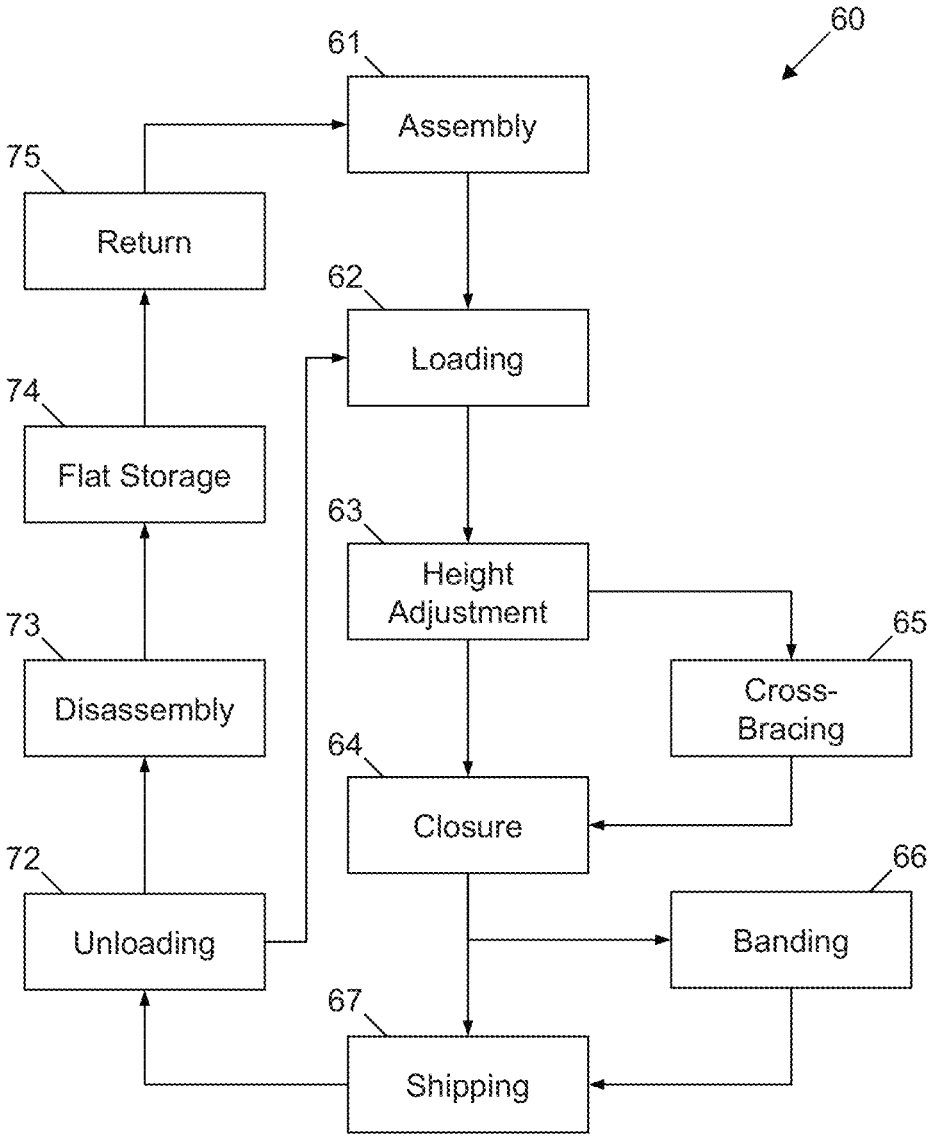
FIG. 6 is a block diagram of a shipping method for a self-supporting, interlocking shipping container system.

FIG. 6 is a block diagram of method 60 for utilizing a shipping container, for example shipping container system 10 as shown in FIGS. 1-3, 4A-4C, and 5. Method 60 includes assembly (step 61), loading (step 62), shipping height adjustment (step 63), and closing the container (step 64).

In some embodiments, cross bracing is provided (step 65) to support the cover panel, and shipping bands may be installed (step 66) before shipping (step 67). On arrival at the shipping destination, any shipping bands are removed, and the container is opened for unloaded (step 72).

Depending on application, the shipped container can be disassembled (step 73) and stored flat (step 74), returned in disassembled or assembled form (step 75), or reassembled (step 61) for additional use. Alternatively, the shipped container can be reloaded (step 62) without disassembly, for shipping finished materials or products back to the originating location, or to another vendor, customer, or supplier.

Based on these features, the interlocking crate design and shipping techniques described here address several issues within the glass services and general shipping markets. For example, the interlocking crate design of shipping container 10 takes up little space when disassembled and not in use, as compared to fixed-configuration packing crate designs. The interlocking crate design is also easy to assemble and disassemble, with little or no fasteners needed, and sturdy in assembled form, allowing finished product deliveries to arrive in good condition at the end user location. The interlocking crate design can also be used multiple times, and built with readily available, green, renewable materials selected for durability and cost effectiveness.

This contrasts with other practices, where glass panels and other fragile or sensitive deliverables are sent on wrapped pallets, or using custom, oversized and overbuilt crate configurations, which are difficult to assemble and take apart, and occupy large areas of the available space on shop and warehouse floors when not in use. In the interlocking design of the present disclosure, on the other hand, a wide range of finished goods including boxed glass and other load-sensitive deliverables can be accommodated. Container system 10 can also be shipped as standard freight by a range of different carriers, providing additional delivery options and greater flexibility to get products direct to customers in the desired quantities, at cost effective rates, and under time-sensitive scheduling constraints.

While this disclosure has been described with reference to exemplary embodiments, it will be understood by those skilled in the art that various changes may be made and equivalents may be substituted for elements thereof, without departing from the spirit and scope of the invention. In addition, modifications may be made to adapt the teachings of the invention to particular situations and materials, without departing from the essential scope thereof. Thus, the invention is not limited to the particular examples that are disclosed herein, but encompasses all embodiments falling within the scope of the appended claims.

The invention claimed is:

1. A shipping container system comprising:

a bottom panel with interlocking features disposed about a perimeter thereof;

a plurality of side panels with interlocking features disposed about perimeters thereof, the side panels interlocking with the bottom panel to assemble a self-supporting shipping container;

a plurality of horizontally oriented slots formed in an opposing pair of the side panels, the slots arranged at different heights between the bottom panel and a top edge of the side panels;

vertically oriented channels formed in the opposing pair of side panels, the vertically oriented channels extending along and adjoining the horizontally oriented slots;

a cross member positioned at a selected one of the different heights by insertion into an opposing pair of the slots, the cross member configured to restrain one or more shipping units inside the shipping container against vertical motion with respect to the bottom panel; and a top panel with interlocking features disposed about a perimeter thereof, the top panel interlocking with the side panels to cover the shipping container, wherein the top panel is spaced above the one or more shipping units at a clearance maintained by the cross member, wherein the interlocking features are selected from a group consisting of complementary tongue-in-groove features, interlocking tabs, and castellations.

2. The system of claim 1, further comprising a cross brace spanning an opposing pair of the side panels at the top edge thereof, the cross brace configured to support the top panel against external loading.

3. The system of claim 2, wherein the cross brace is spaced above the plurality of shipping units inside the shipping container, such that the cross brace substantially isolates the shipping units from the external loading by transferring the external loading to two or more of the side panels.

4. The system of claim 1 wherein the interlocking features are configured for assembly of the bottom panel, the side panels, and the top panel into the self-supporting shipping container without separate mechanical fasteners.

5. The system of claim 4, wherein the interlocking features are further configured for disassembly of the bottom panel, the plurality of side panels, and the top panel using a pry tool.

6. The system of claim 1, wherein the vertically oriented channels have a horizontal width configured for positioning the cross member at the selected height within the assembled shipping container by insertion along one said channel and into the opposing pair of slots.

7. The system of claim 6, wherein the opposing pair of slots are configured to retain the adjustable cross member in a compressive loading relationship with respect to the one or more shipping units.

8. The system of claim 7, wherein the one or more shipping units comprise a plurality of stacked glass plates extending across a horizontal surface area of the bottom panel.

9. An apparatus comprising:

interlocking bottom and side panels assembled into a shipping container, wherein the shipping container is self-supporting without mechanical fasteners;

a plurality of shipping units disposed within the self-supporting shipping container and stacked substantially parallel to the bottom panel;

a plurality of horizontally oriented slots formed in an opposing pair of the side panels, the slots arranged at different heights above the bottom panel;

a cross member inserted within an opposing pair of the slots, the opposing pair of slots having a height selected to position the cross member for retaining the shipping units against vertical motion in a compressive loading arrangement;

a top panel configured for interlocking with the plurality of side panels to cover the shipping container, wherein the top panel is spaced above the plurality of shipping units at a clearance maintained by the cross member; and a cross brace positioned between an opposing pair of the side panels at a top edge thereof, the cross brace configured to support the top panel against external loading.

10. The apparatus of claim 9, wherein the shipping units comprise a plurality of stacked glass plates extending across a horizontal surface area of the bottom panel.

11. The apparatus of claim 10, further comprising a spacer positioned between the cross member and the shipping units, the spacer configured to convey the compressive loading from the cross member to the plurality of stacked glass plates.

12. The apparatus of claim 9, wherein the interlocking features comprise one or more pry openings for disassembly of the self-supporting shipping container into the top, side and bottom panels without removal of any mechanical fasteners.

13. The apparatus of claim 9, further comprising one or more shipping bands disposed about the shipping container, the shipping bands configured to exert compressive loading to retain the top, bottom and side panels in position during transport.

14. A method comprising:

assembling a plurality of interlocking side panels and an interlocking bottom panel to form a self-supporting shipping container;

loading the self-supporting shipping container with a plurality of shipping units, the shipping units extending across the bottom panel in a substantially parallel orientation;

inserting a cross piece into a pair of opposing horizontal slots formed in the side panels, the slots formed at a height selected to position the cross piece to restrain the shipping units against vertical motion in a compressive loading arrangement;

inserting a cross brace between an opposing pair of the side panels, the cross brace positioned along a top edge thereof; and closing the shipping container with an interlocking top panel, wherein the top panel is spaced above the shipping units with a clearance maintained by the cross piece, such that the cross brace isolates the shipping units from compressive loading on the top panel by transferring the compressive loading to the side panels.

15. The method of claim 14, wherein inserting the cross piece comprises inserting the cross piece along vertical channels extending from top edges of opposing side panels to the pair of opposing slots.

16. The method of claim 15, further comprising disassembling the top, side and bottom panels without removal of any mechanical fasteners.

* * * * *